US010557620B2

(12) United States Patent
Felt

(10) Patent No.: US 10,557,620 B2
(45) Date of Patent: Feb. 11, 2020

(54) EXPANDABLE BULB-HOLDING CLIP

(71) Applicant: Russel Williams Home Services LLC, Plymouth, MN (US)

(72) Inventor: David Russel Felt, Plymouth, MN (US)

(73) Assignee: Russel Williams Home Services LLC, Maple Plain, MN (US)

( * ) Notice: Subject to any disclaimer, the term of this patent is extended or adjusted under 35 U.S.C. 154(b) by 0 days.

(21) Appl. No.: 16/404,640

(22) Filed: May 6, 2019

(65) Prior Publication Data

US 2019/0257502 A1 Aug. 22, 2019

Related U.S. Application Data

(63) Continuation-in-part of application No. 15/067,119, filed on Mar. 10, 2016, now Pat. No. 10,281,084.

(60) Provisional application No. 62/131,305, filed on Mar. 11, 2015.

(51) Int. Cl.
*F21V 21/088* (2006.01)
*F21W 121/00* (2006.01)

(52) U.S. Cl.
CPC ..... *F21V 21/088* (2013.01); *F21W 2121/004* (2013.01)

(58) Field of Classification Search
CPC ... F16M 13/022; F21V 33/006; F21V 21/088; F21V 21/0885; E04D 13/064
USPC ..... 248/200, 205.6, 229.16, 222.11, 222.12, 248/229.26, 316.7, 300; 362/391, 396, 362/249.01, 249.04, 152
See application file for complete search history.

(56) References Cited

U.S. PATENT DOCUMENTS 990,856 A * 5/1911 Freiberg ..... F16M 13/02 248/126
5,566,058 A * 10/1996 Protz, Jr. ..... F21V 21/08 362/249.09
5,581,956 A * 12/1996 Fennessy ..... F21V 21/088 248/237
5,607,230 A * 3/1997 Protz, Jr. ..... F21V 21/08 248/229.16
5,921,511 A * 7/1999 LaPointe ..... F21V 21/08 248/58
6,502,958 B1 * 1/2003 Chen ..... F21V 21/088 362/249.14
6,536,727 B1 * 3/2003 Limber ..... F16B 2/22 248/227.1
6,572,062 B1 * 6/2003 Limber ..... F21V 21/088 248/227.1
8,459,712 B2 * 6/2013 Thrasher ..... B25B 31/00 248/219.2
8,545,041 B2 * 10/2013 Brown ..... A42B 1/24 24/336

(Continued)

*Primary Examiner* — Muhammad Ijaz
(74) *Attorney, Agent, or Firm* — Jordan One; Greenberg Traurig, LLP

(57) ABSTRACT

A decorative removable lighting enclosed clip made for mounting a light to a support surface such as gutters, shingles or a building structure is disclosed. The clip may include an expandable bulb holder adapted to permit passage of a bulb that is larger than the resting diameter of the bulb holder. In some embodiments, the clip includes a slot that bisects a portion of the clip into sections that can flex away from each other, which enables the bulb holder to expand when subjected to a force. As a result, the clip may be installed with a decorative light strand without having to remove the bulbs from their sockets.

19 Claims, 7 Drawing Sheets

(56) References Cited

U.S. PATENT DOCUMENTS

| | | | | |
|---|---|---|---|---|
| 2002/0186562 | A1* | 12/2002 | Schroetter | F21V 21/088<br>362/249.01 |
| 2006/0152927 | A1* | 7/2006 | Vendrick | F21V 21/088<br>362/249.01 |
| 2008/0135703 | A1* | 6/2008 | Craig | A47B 96/061<br>248/229.16 |
| 2012/0241575 | A1* | 9/2012 | Martinez Sanz | F24S 10/40<br>248/231.81 |

* cited by examiner

EXPANDABLE BULB-HOLDING CLIP

CROSS-REFERENCE TO RELATED APPLICATIONS

This application is a continuation-in-part of U.S. patent application Ser. No. 15/067,119, filed Mar. 10, 2016, which claims priority to and the benefit of U.S. Provisional Patent Application No. 62/131,305, filed Mar. 11, 2015, the entireties of which are incorporated herein by reference.

FIELD OF THE DISCLOSURE

The present disclosure generally relates to clips and fasteners for maintaining decorations, such as holiday lights, on gutters, shingles, or other structures. Specifically, the present disclosure relates to clips and fasteners capable of being mated to a bulb or other decoration.

BACKGROUND

The present disclosure generally relates to attaching linear systems, decorative holiday lighting displays, ornamental light strings, misting systems, or the like to surfaces, such as gutters and other structural surfaces. Embodiments disclosed herein may be used for attaching strands of lights and the like on the exterior of homes, buildings or other structures using an enclosed gutter clip. Depending on the particular clip design, a bulb may be positioned at different angles with respect to a roofline, gutter or other support surface. Gutter clips are typically designed to accommodate a bulb of a particular size and shape (e.g., C7, C9, mini bulbs, and/or other bulb sizes).

In existing gutter clip designs, a portion of the clip is positioned between a bulb and its socket, such that preparing to hang a strand of holiday lights typically involves the removal of bulbs from their sockets, positioning clips in alignment with the sockets, and screwing the bulbs back into place. Such arrangements may advantageously provide a strong mechanical connection between the decorative light strand and the clips, reducing the chance that a bulb and clip become accidentally disengaged. The strong mechanical connection between the strand and gutter clips may, in some cases, enable a user to remove an entire strand of lights from a gutter or shingles by pulling on the strand itself with sufficient force. However, in order to attain these benefits with typical gutter clip designs, the tedious and time-consuming bulb removal process must first be completed.

It is therefore an object of the present disclosure to provide a gutter clip that substantially maintains the advantage of a mechanically-secure connection, while obviating the need to perform the bulb removal process.

SUMMARY

It has become increasingly popular to decorate the outside of buildings, homes and other structures with lights. These lights are generally arranged as a string of lights along a powered cord. Each individual light may be attached to a clip according to the present disclosure, which itself is adapted to mount to a gutter, shingle, or other structure. The clips of the present application may be designed to maintain a bulb at a particular angle and/or orientation, so as to provide a pleasing appearance.

Decorative lighting clips, such as gutter or shingle clips, are often sold as aftermarket products separately from strands of lights. An installer may then mate the clips with the strand at desired intervals, and then attach the clips to a gutter, shingle, or other structure. The process of joining clips to a light strand can be tedious and time-consuming. For instance, joining existing clips to strands with larger bulbs, such as C7 or C9 bulbs, typically involves removing each bulb from its socket, positioning the clip in between the socket and the bulb, and screwing the bulb into place. Depending on the number of decorative lights being installed, this process can take a substantial amount of time. Moreover, for installers that provide home decoration services, the typical clip installation process may limit the number of homes that can be decorated over some period of time.

The present disclosure includes the realization that some decorative lighting bulbs (e.g., C7 and C9 bulbs, among other types of bulbs) have an asymmetric ellipsoidal shape (e.g., an ovoid or egg-like shape). Moving from the "front" end of such bulbs toward the "rear" end (the end having a metallic screw threading that engages with a socket), the diameter of the bulbs gradually increases until a maximum diameter portion is reached. Then, from the maximum-diameter portion to the rear end of the bulb, the diameter decreases more drastically, leading to an asymmetric shape. Embodiments of the present disclosure leverage this bulb asymmetry in order to provide a clip capable of widening to accommodate passage of a bulb in one direction (e.g., pushing the front end of the bulb through the rear of the clip), but resists passage of the bulb in the reverse direction (e.g., pulling the back end of the bulb through the front of the clip). As a result, clips of the present application may be installed with relative ease by pushing the clips over the front of the bulbs, without having to unscrew the bulbs from their sockets. In addition, due in part to the asymmetric shape of the bulbs, the clips may be difficult to pull off the bulbs once installed, enabling more efficient removal of lighting strands from their attached structure (e.g., by pulling the entire strand, rather than carefully removing each clip individually).

An example clip of the present disclosure includes a substantially circular bulb holder, which has a resting diameter that is smaller than the maximum diameter of a bulb. The clip may be made of any type of suitable plastic that is substantially rigid, but able to flex or deform to a limited degree. The clip includes a slot extending from the bulb holder, which enables the bulb holder to expand, such that its diameter can increase beyond its resting diameter. The clip, when pressed against a bulb having a maximum diameter that is larger than the resting diameter of the bulb holder, may expand or otherwise deform as the bulb passes through the bulb holder. The slot may extend along portions of the clip, such that a substantial portion of the clip is capable of flexing outwardly.

In addition to the example described above, other designs or structures may be used to impart a similar functionality onto the clips. For example, a bulb holder may include one or more cutouts that similarly enables the bulb holder to flex or otherwise accommodate passage of an object therethrough that is larger than its resting diameter. Additionally, the size and shape of the slot may vary, depending on the particular material used to construct the clip, a desired amount of flexibility, and/or other factors. Regardless of the particular implementation, one of ordinary skill would appreciate that various aspects of the clips described herein may be modified to suit a variety of purposes, while still providing a clip that is capable of being installed without the need to unscrew bulbs from their sockets.

In a first aspect of the present application, a clip includes an elongated body, a strut, a cantilever, a substantially circular bulb holder, and a slot. The elongated body has a first end and a second end. The strut has a first end and a second end. The first end of the strut is rigidly connected to the second end of the elongated body. The cantilever has a first end and a second end. The first end of the cantilever is rigidly connected to the second end of the strut. The substantially circular bulb holder is rigidly connected to and extends from the first end of the cantilever in a direction substantially opposite the second end of the cantilever. The bulb holder includes a hole having a first diameter that is configured to receive at least a portion of a bulb. The slot extends from the hole of the bulb holder and toward the second end of the cantilever. The slot and the hole of the bulb holder form a continuous space to enable the hole to temporarily deform and permit passage of the at least a portion of a bulb, with the bulb having a second diameter that is larger than the first diameter of the hole. The second end of the cantilever is resiliently capable of being pulled away from the elongated body to accommodate the positioning of a structure between the elongated body and the cantilever. The clip is made from a substantially resilient material having a memory that causes the second end of the cantilever to return toward a relaxed position when not subject to an external force. When the structure is situated between the elongated body and the cantilever, the memory causes the second end of the cantilever to return toward the relaxed position, such that the cantilever and the elongated body exert pressure on the structure, to thereby maintain the position of the clip about the structure.

In a second aspect of the present application, a clip includes a gripping section, a substantially circular bulb holder, and a cutout. The gripping section includes at least a body and a cantilever rigidly coupled to the body, with the cantilever being resiliently capable of being pulled away from the elongated body to accommodate the positioning of a structure between the body and the cantilever. The gripping section is made from a substantially resilient material having a memory that causes the cantilever to return toward a relaxed position when not subject to a force. The substantially circular bulb holder is rigidly connected to and extends from the gripping portion. The bulb holder includes a hole having a first diameter and is adapted to receive at least a portion of a bulb. The cutout extends from the hole and through at least a portion of the gripping section, and enables the hole to expand and permit passage of a bulb having a second diameter that is larger than the first diameter.

In a third aspect of the present application, a clip for mounting decorative light bulbs includes a first gripping section, a second gripping section, and a bulb holder. The first gripping section includes a first body section and a second cantilever section. The second gripping section includes a second body section and a second cantilever section. The bulb holder is coupled to the first gripping section and the second gripping section, and includes a hole having a resting diameter. The clip is formed from a substantially resilient material capable of temporary deformation. The first gripping section and the second gripping section are adapted to expand away from each other to, in turn, cause the hole of the bulb holder to expand, such that the bulb holder is adapted to permit passage of an object therethrough having a diameter that is larger than the resting diameter of the hole of the bulb holder.

The foregoing summary is illustrative only and is not intended to be in any way limiting. In addition to the illustrative aspects, embodiments, and features described above, further aspects, embodiments and features will become apparent by reference to the drawing figures, the following detailed description, and the claims.

BRIEF DESCRIPTION OF THE DRAWINGS

To assist in understanding the disclosure, and to show how embodiments of the present application may be implemented, there will now be described by way of example specific embodiments, apparatuses, systems, and methods with reference to the accompanying drawings, in which.

DETAILED DESCRIPTION OF THE EMBODIMENTS

Figure 1:
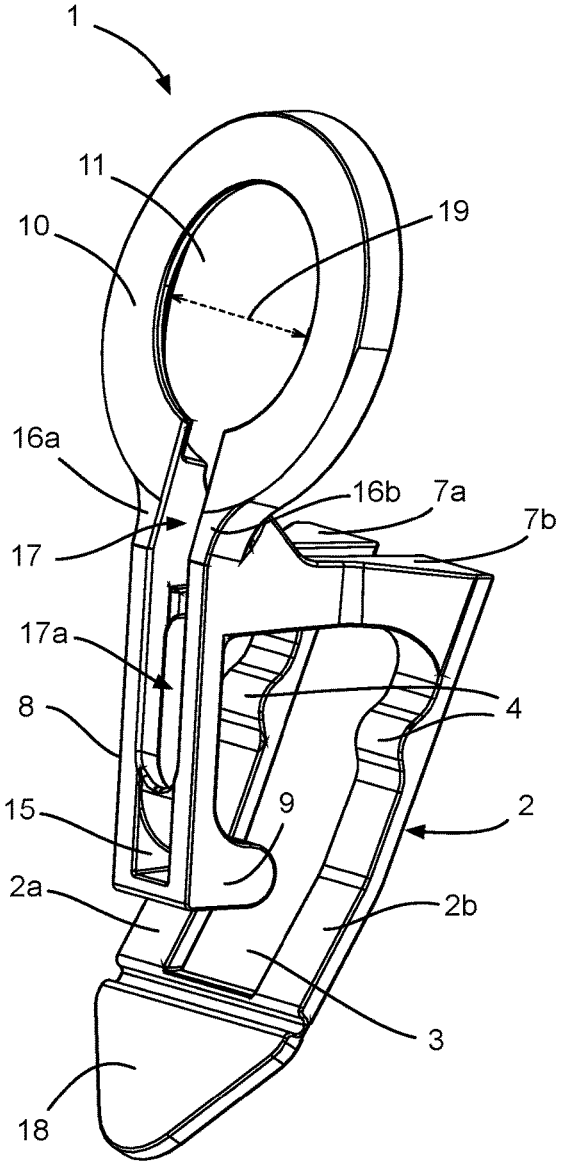
FIG. 1 is a front perspective view of an example gutter clip, according to an embodiment of the present application.
Figure 2:
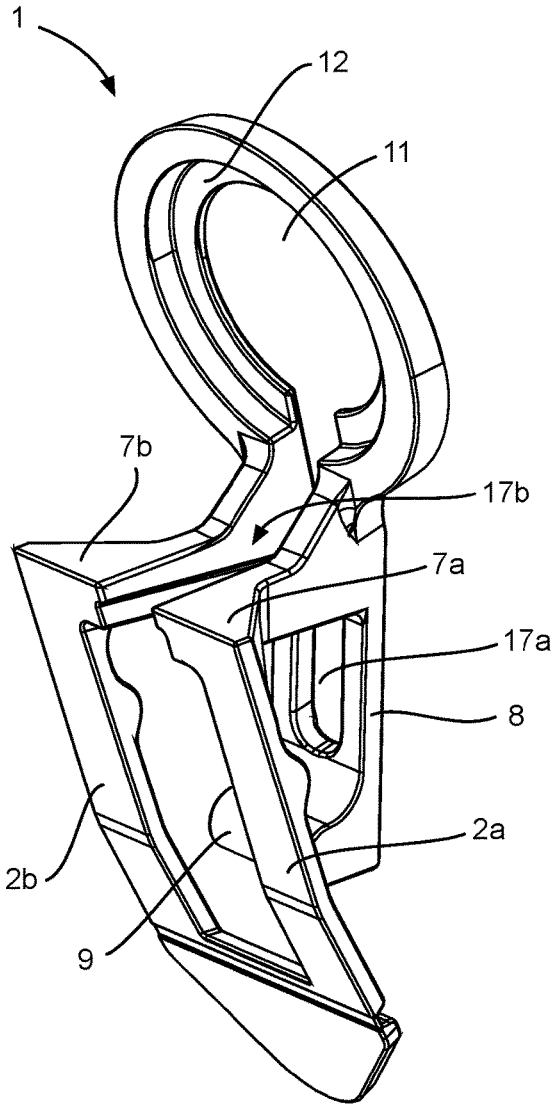
FIG. 2 is a rear perspective view of the example gutter clip, according to an embodiment of the present application.
Figure 3:
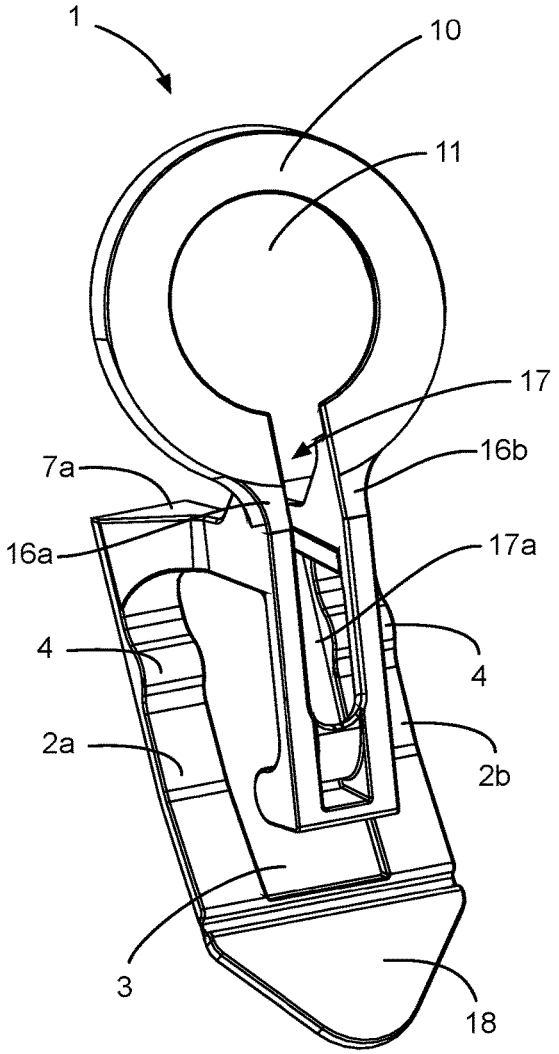
FIG. 3 is a front perspective view of the example gutter clip, according to an embodiment of the present application.
Figure 4:
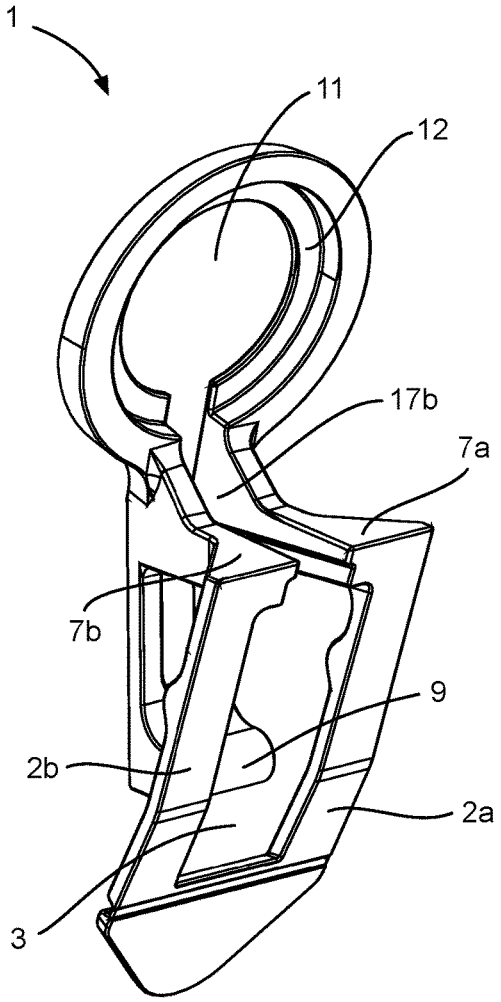
FIG. 4 is a rear perspective view of the example gutter clip, according to an embodiment of the present application.
Figure 5:
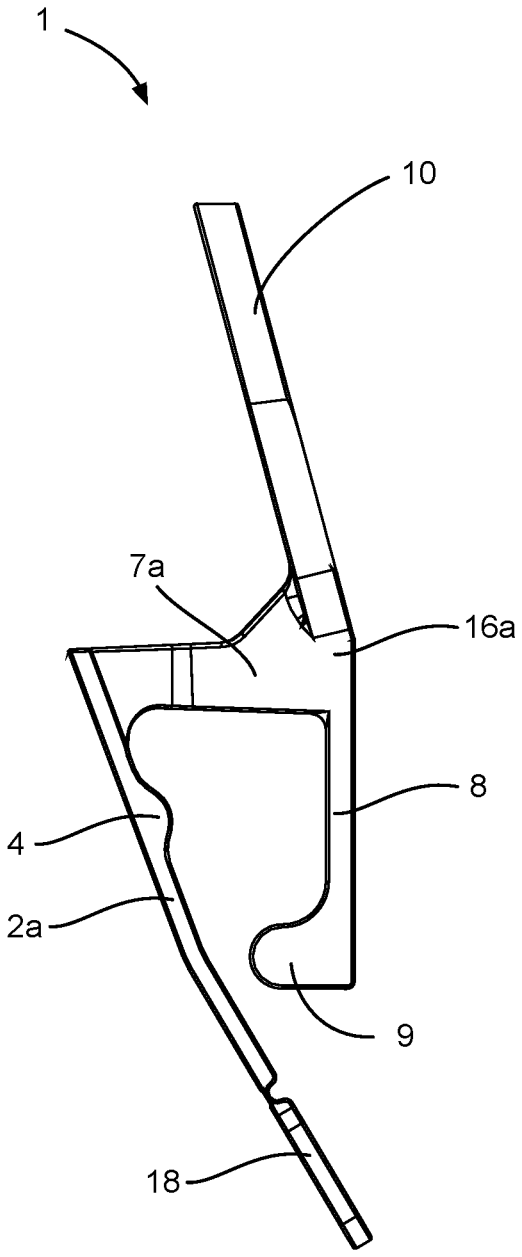
FIG. 5 is a side elevated view of the example gutter clip, according to an embodiment of the present application.
Figure 6:
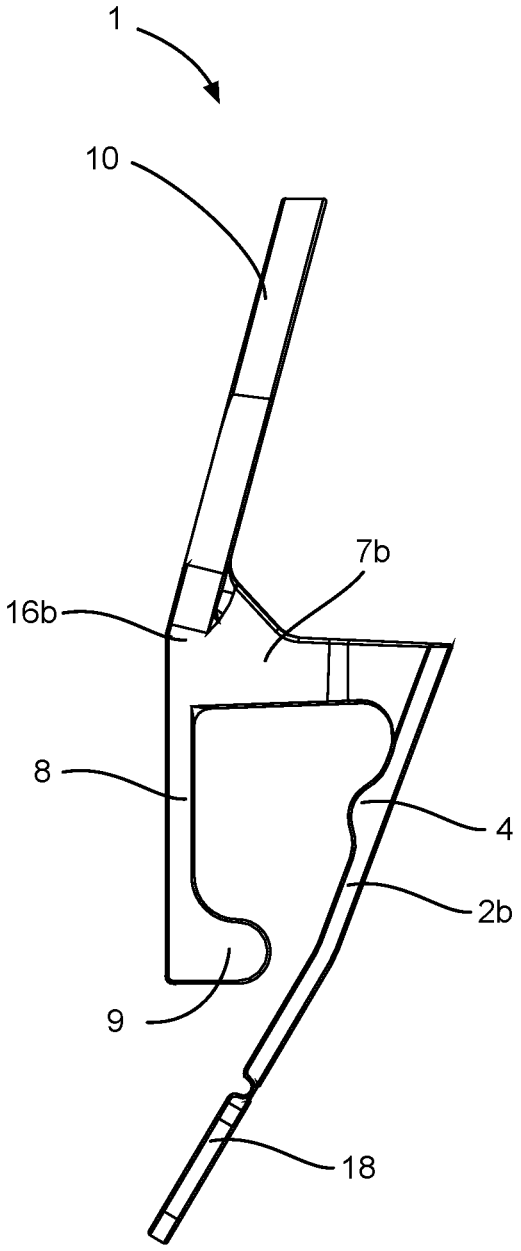
FIG. 6 is a side elevated view of the example gutter clip, according to an embodiment of the present application.
Figure 7:
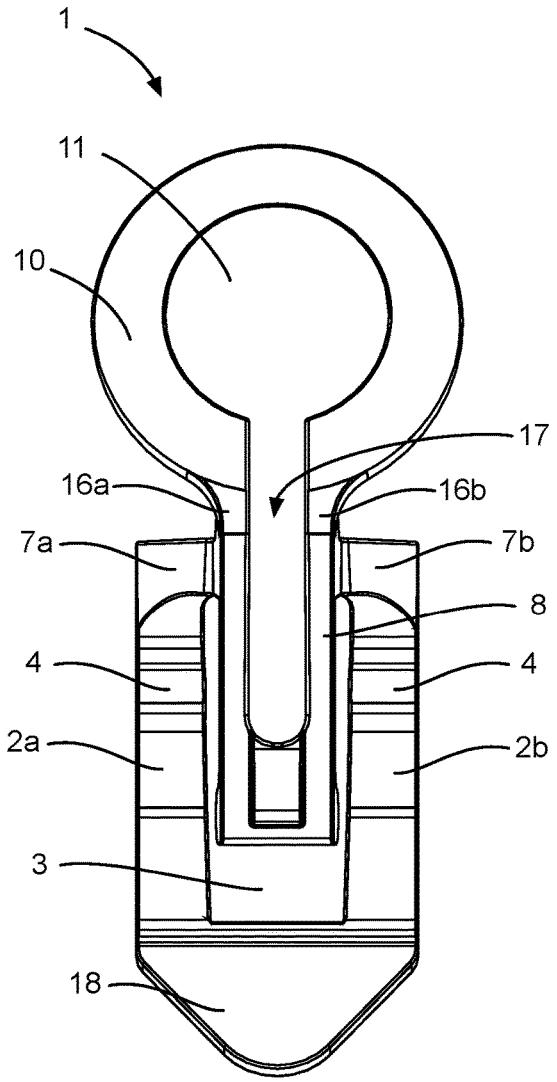
FIG. 7 is a front elevated view of the example gutter clip, according to an embodiment of the present application.
Figure 8:
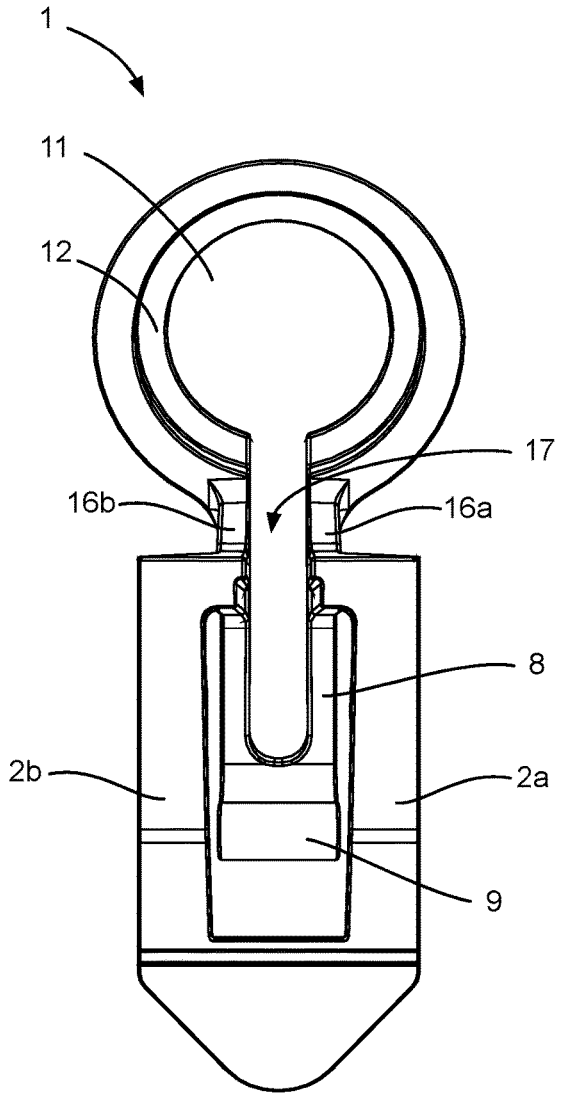
FIG. 8 is a rear elevated view of the example gutter clip, according to an embodiment of the present application.
Figure 9:
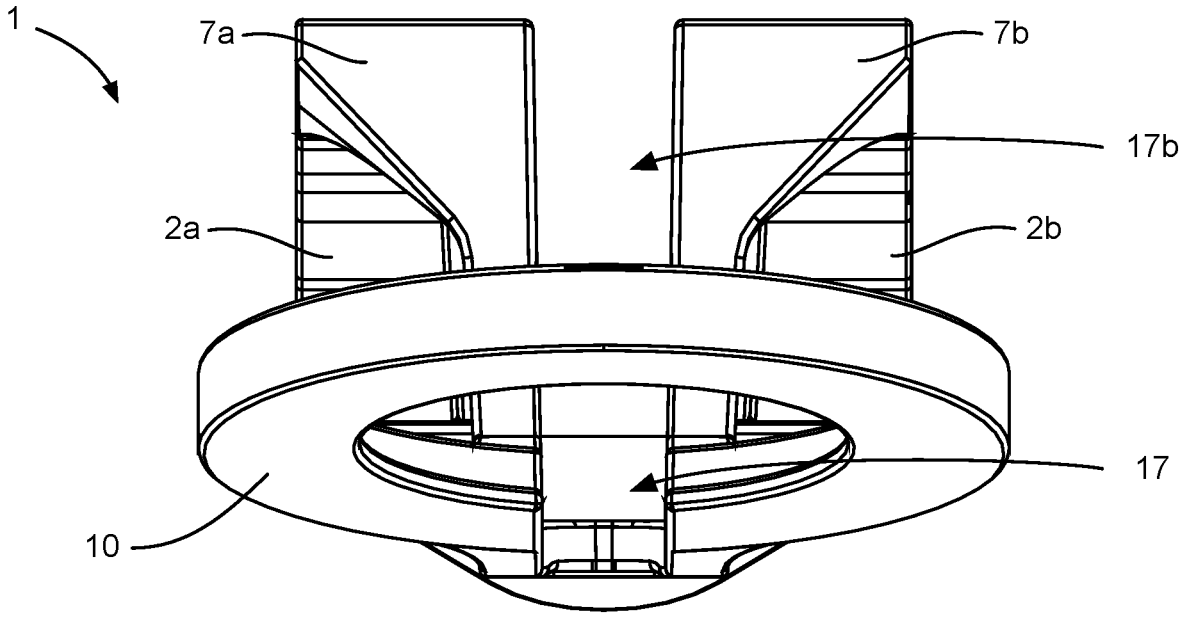
FIG. 9 is a top plan view of the example gutter clip, according to an embodiment of the present application.
Figure 10:
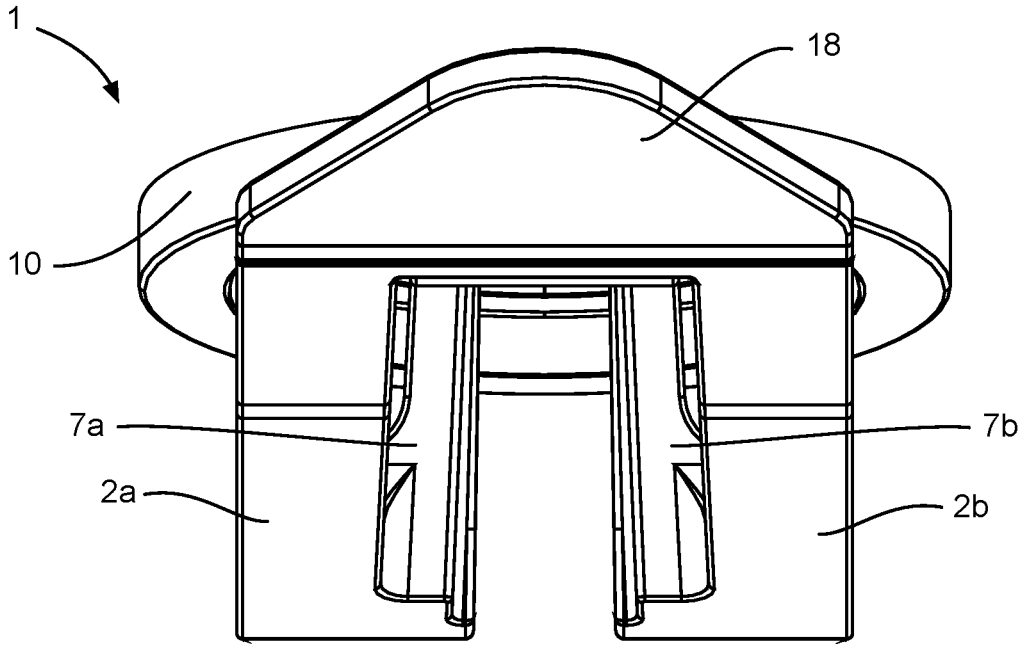
FIG. 10 is a bottom plan view of the example gutter clip, according to an embodiment of the present application.

There will now be described, by way of example, several embodiments of the present application as contemplated by the inventor. In the following description, specific details are set forth in order to provide a thorough understanding of the embodiments. It will be apparent, however, that the embodiments of the present disclosure may be practiced without limitation to these specific details. The specific embodiments disclosed herein are not intended to limit the scope of the present application.

FIGS. 1-10 illustrate various views of a clip 1 according to an embodiment of the present application. The clip 1 includes an elongated body 2, a strut formed from strut sections 7*a* and 7*b*, a cantilever 8, and a bulb holder collectively formed from outer flange 10, hole 11, and socket guide ridge 12. The strut extends between and rigidly couples the body 2 and the cantilever 8, such that the body 2, the strut, and the cantilever (collectively referred to herein as a "gripping section" or "attachment section") form a substantially "U-shaped" or "C-shaped" structure.

In some implementations, such as the embodiment depicted in FIGS. 1-10, the angles between the body 2 and the strut, and between the strut and the cantilever 8 may be less than 180 degrees, such that the end of the cantilever 8 opposite to its point of attachment with the strut converges toward the body 2. In these implementations, the cantilever 8 may be movable with respect to the body 2 to accommodate the positioning of a gutter, shingle, or other structure in between the cantilever 8 and the body 2. When installed onto a gutter, shingle, or other structure, the cantilever 8 applies a force toward the body 2, which serves to hold the clip 1 firmly in place.

In some embodiments, the cantilever 8 includes a lobe 9 extending toward the body 2. Additionally, and/or alternatively, the body 2 may include one or more protrusions 4 extending toward the cantilever 8. The lobe 9 and/or the one or more protrusions 4 may increase the effective gripping force between the cantilever 8 and the body 2 when positioned about a structure. The shapes and sizes of the lobe 9 and the one or more protrusions 4 may vary, depending on a desired amount of gripping force, the particular structure about which the clip 1 is designed to attach, and/or various other factors.

The clip 1 also includes a substantially circular bulb holder, which is formed from an outer flange 10, a socket guide ridge 12, and a hole 11 having a resting diameter 19. The bulb holder is adapted to receive a bulb (e.g., a C7 or C9 bulb) oriented with its major axis (e.g., the axis extending from the front tip of the bulb through the electrical contacts at the rear end of the bulb) extending through the hole 11.

The clip 1 further includes a slot 17 extending from the hole 11 and through portions of the cantilever 8, strut, and body 2. For example, a portion 17*a* of the slot 17 may extend through at least some of the length of the cantilever 8. In addition, a portion 17*b*of the slot 17 may extend across some or all of the strut, dividing the strut into strut sections 7*a* and 7*b* . Furthermore, a portion 3 of the slot 17 may effectively extend through a portion of the body 2, forming body sections 2*a* and 2*b*.

The slot 17 (including portion 17*a*, portion 17*b*, and/or portion 3), which may bisect a portion of the clip 1, enables the hole 11 to expand beyond its resting diameter 19. Example illustrations of this expansion process is shown and described in more detail with respect to FIGS. 11A-11C. As an object with a larger diameter than the resting diameter 19 of the hole 11 is pressed against the socket guide ridge 12 of the bulb holder, the opposing portions of the clip 1 (e.g., a first portion formed from part of cantilever 8, strut section 7*a*, and body section 2*a*, and a second portion formed from part of cantilever 8, strut section 7*b*and body section 2*b*) are able to move apart from each other, which in turn causes the hole 11 to expand in diameter. In this manner, a bulb or other object may pass through the hole 11 of the bulb holder, without having to remove the bulb from its socket or otherwise perform any disassembly steps.

Although the slot 17 is shown in FIGS. 1-10 as having a particular size and shape, it will be appreciated that the particular dimensions and design of slot 17 may vary among different implementations. For example, different materials, such as plastics or synthetic resins, may exhibit different levels of flexibility (e.g., the ability to temporarily deform when subjected to a force and return to an original form-factor when no forces are applied to the material). It will be appreciated that the size, shape, and extent of the slot 17 may vary based on the material used to construct the clip 1. For instance, the size and extent to which the slot 17 extends through the clip 1 may be diminished relative to the dimensions shown in FIGS. 1-10 for clips constructed from plastics that exhibit high levels of flexibility.

The embodiments according to the present disclosure may be described as including a bisected "gripping structure" that is separated into two gripping structure sections. For instance, the "left" side of the clip 1 may include the left side of the cantilever 8, the strut section 7*a*, and the body section 2*a*. Likewise, the "right" side of the clip 1 may include a right side of the cantilever 8, the strut section 7*b*, and the body section 2*b*. The opposing "left" and "right" gripping structure sections may be rigidly coupled to each other at one or more locations of the clip 1, such as near the bottom of the body 2 and/or near the tip of the cantilever 8. The left and right gripping structure sections may be pulled apart from each other to some degree, which in turn causes the hole 11 of the bulb holder to expand in diameter.

The clip 1 may further include a neck formed from neck sections 16*a* and 16*b*, which are separated by slot 17. The neck may be a portion of material that extends between the outer flange 10 and the socket guide ridge 12 of the bulb holder and the cantilever 8 and/or the strut sections 7*a* and 7*b*. In addition, the clip 1 may include one more triangularly-shaped gussets or reinforcement structures at various locations along the clip (e.g., between the strut sections 7*a* and 7*b*and the neck sections 16*a* and 16*b*, respectively, and/or between the strut sections 7*a* and 7*b*and the body portions 2*a* and 2*b*, respectively), which may strengthen particular aspects of the clip 1.

Some optional aspects of the clip 1 are shown in FIGS. 1-10, which may be included or excluded depending on the particular implementation. An opening 15 may be included toward the end of the cantilever 8 near the lobe 9, which may reduce the amount of material used in constructing the clip 1, and/or may reduce the likelihood of the material clotting as it flows through a die tool. In some use cases, a hinge 18 may be included in clip 1, which may be foldable along the crease between the body 2 and the hinge 18. The hinge 18 may be used to assist in mounting the clip 1 to certain structures, such as shingles.

Figure 11C:
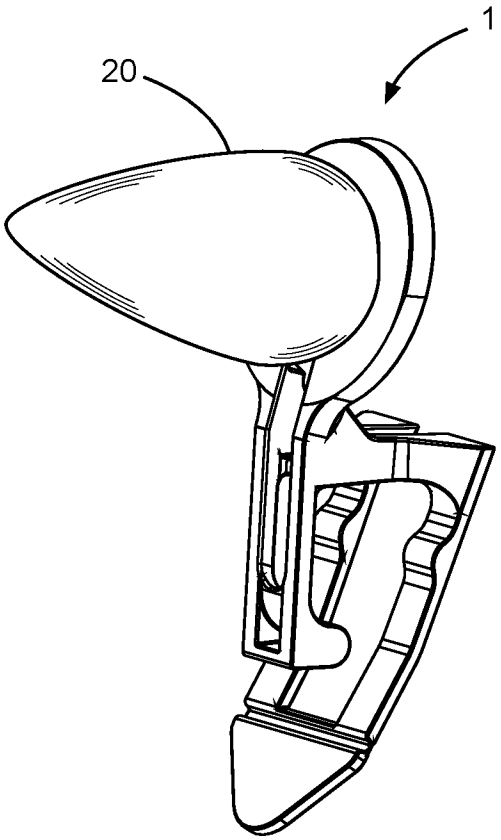
FIGS. 11A, 11B, and 11C illustrate an example installation process for a bulb relative to the example gutter clip, according to an embodiment of the present application.
Figure 11B:
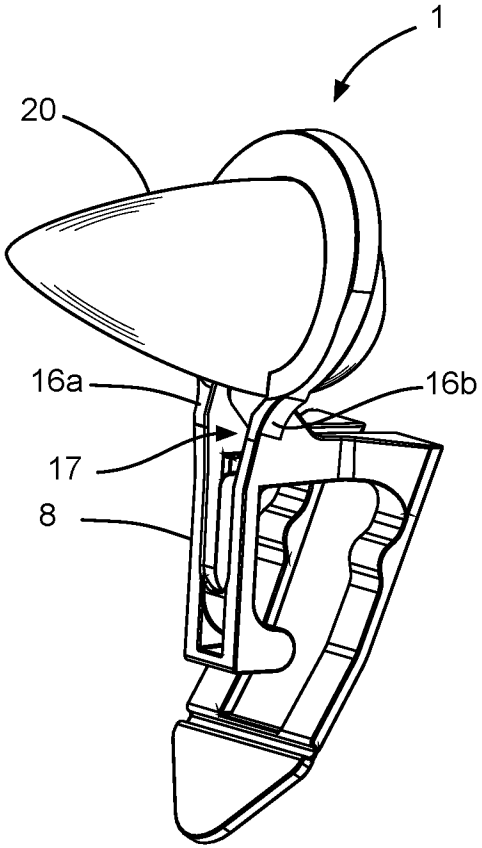
Figure 11A:
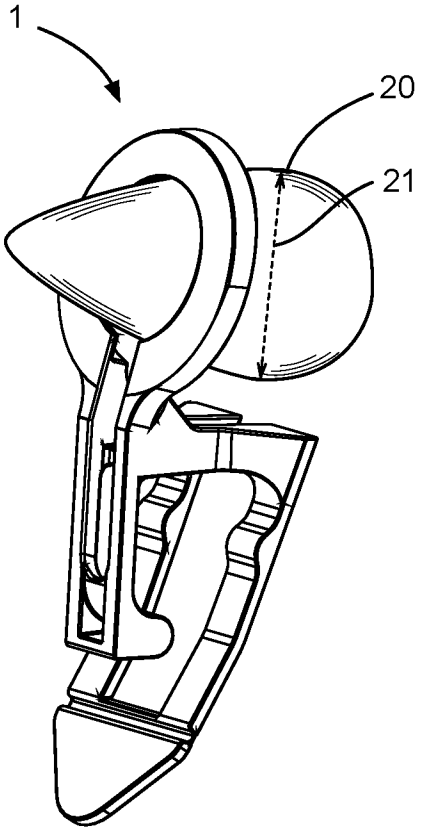

FIGS. 11A-11C depict an example installation process for the clip 1, according to an example embodiment of the present application. As described above, the hole 11 of the clip 1 has a resting diameter 19. In the example illustrated in FIGS. 11A-11C, a bulb 20 has a maximum diameter 21 that is larger than the resting diameter 19. For typical clips, the bulb 20 would not be able to pass through the bulb holder. However, the clips according to the present disclosure are designed to deform, expand, or otherwise flex to accommodate passage of the bulb 20, despite its maximum diameter 21 being larger than the resting diameter 19 of the hole 11 of the bulb holder of clip 1.

In FIG. 11A, the clip 1 is pressed against bulb 20, such that the front end of the bulb 20 passes through the hole 11 from the rear side of the bulb holder toward the front end of the bulb holder. At the stage shown in FIG. 11A, the bulb 20 has partially passed through the hole 11, up until the diameter of the bulb 20 is approximately the same as the resting diameter 19 of the hole 11. With a typical clip, the bulb 20 might not be able to extend much farther through the bulb hole.

Between FIGS. 11A and 11B, the clip 1 is pressed against the bulb 20. The gradual increase in diameter of the bulb 20 may cause the bulb holder to expand, and may also cause the opposing sections of the cantilever 8, the strut sections 7*a* and 7*b*, and the body sections 2*a* and 2*b* to flex away from each other. In this manner, the diameter of the bulb holder expands to at least the maximum diameter 21 of the bulb 20, thereby enabling passage of the bulb 20 through the bulb holder, as shown in FIG. 11B.

After the maximum diameter 21 portion of the bulb 20 has passed through the bulb holder, the diameter of the bulb 20 more rapidly decreases (due to the asymmetric ovoid shape of the bulb), allowing the clip 1 to return to its resting position, as shown in FIG. 11C. As shown in FIGS. 11A-11C, the clip designs of the present disclosure can be installed without the tedious and time-consuming steps of disengaging and re-engaging the bulbs from their electrical contacts or sockets.

Figure 12:
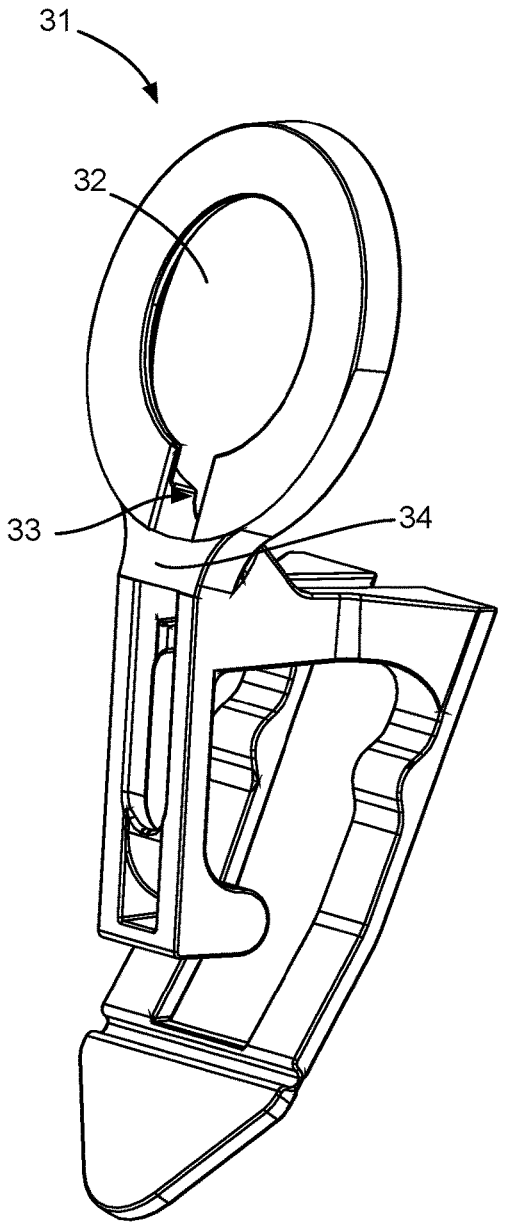
FIG. 12 is a front perspective view of an alternative example gutter clip, according to an embodiment of the present application.
Figure 13:
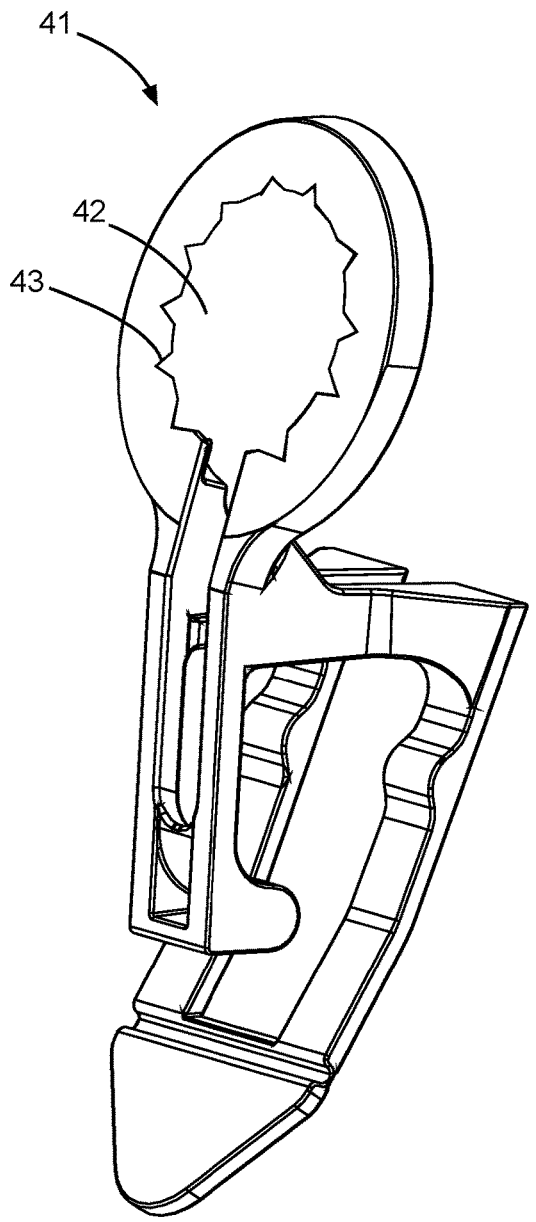
FIG. 13 is a front perspective view of an alternative example gutter clip, according to an embodiment of the present application.

FIGS. 12 and 13 depict example alternative embodiments of the present disclosure. Referring now to FIG. 12, a clip 31 includes a cutout 33 that is similar to the slot 17 in FIGS. 1-10. In this example, however, the cutout 33 terminates at the neck 34, and does not continuously extend through to the cantilever, strut, or body portions of the clip 31. Depending on the particular implementation, the cutout 33 may enable a satisfactory amount of expansion to bulb hole 32, without extending through the other sections of the clip 31.

Referring now to FIG. 13, a clip 41 includes one or more cutouts 43 around the outer perimeter of hole 42. In this example, multiple triangular cutouts 43 may be formed about the hole 42, effectively forming an inner diameter (defined by the inner diameter of the hole 42) and an outer diameter (defined by the tips of the cutouts 43). Similar in function to the example described above with respect to FIGS. 1-10, the embodiment according to FIG. 13 may allow for passage of bulbs having a maximum diameter that is larger than the inner diameter of the hole 42, as portions of material around the perimeter of hole 42 may be temporarily deformed or flexed when subjected to a force.

Although FIGS. 12 and 13 depict particular alternative embodiments, it will be appreciated that a variety of alternative designs may be implemented based on the teachings of the present disclosure. One or more aspects of a clip, such as the dimensions of its components, the dimensions of its cutouts or holes, the material used to construct the clip, and/or other aspects may lead to different designs not explicitly shown and described herein. The specific examples shown and described herein are not intended to limit the scope of the present application in any way.

As described herein, a "slot" or "cutout" may generally refer to a feature, combination of features, or space that extends along one or more elements of a clip and enables the bulb holder to expand beyond its resting diameter. Neither term is intended to limit the shape or size of the feature, combination of features, or spaces.

The clips according to the present disclosure may be formed from a synthetic resin, and may be integrally formed as a one-piece construction. The clips may be made from a resin which may be an acrylic, a polycarbonate, a nylon, a polyethylene or polypropylene or mixtures thereof. The resin material used to construct the clips of the present disclosure may be able to withstand cold temperatures to reduce the chance that the clips breaks.

Regardless of the specific material used to construct the clips of the present disclosure, the material may be "resilient," flexible, or exhibit elastic qualities. As described herein, a "resilient material" may refer to a material that is able to be deformed, at least to some extent, when subjected to a force, and returns to an original form factor when not subjected to an external force. A structure formed from a resilient material may have a "memory" of its resting or relaxed state, in that the structure may resist deformation, bending, or stretching with a tendency to return to its relaxed state. In addition, aspects of a clip described as "rigidly coupled" herein may refer to a rigid connection between structural elements formed from a resilient material, such that the rigid connection permits some amount of flexibility and/or deformation.

Although certain example methods and apparatus have been described herein, the scope of coverage of this patent is not limited thereto. On the contrary, this patent covers all methods, apparatuses, and articles of manufacture fairly falling within the scope of the appended claims, either literally or under the doctrine of equivalents. Accordingly, this patent specification is intended to embrace all alternatives, modifications and variations of the present invention that have been discussed herein, and other embodiments that fall within the spirit and scope of the above described invention.

It should be understood that arrangements described herein are for purposes of example only. As such, those skilled in the art will appreciate that other arrangements and other elements (e.g. machines, interfaces, operations, orders, and groupings of operations, etc.) can be used instead, and that some elements may be omitted altogether, according to the desired results. Further, many of the elements that are described are functional entities that may be implemented as discrete or distributed components or in conjunction with other components, in any suitable combination and location, or as other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

What is claimed is:

1. A clip comprising:

an elongated body having a first end and a second end;

a strut having a first end and a second end, wherein the first end of the strut is rigidly connected to the second end of the elongated body;

a cantilever having a first end, a second end, and a middle portion disposed between the first end and the second end, wherein the first end of the cantilever is rigidly connected to the second end of the strut;

a substantially circular bulb holder rigidly connected to and extending from the first end of the cantilever in a direction substantially opposite the second end of the cantilever, wherein the bulb holder includes a hole having a first diameter that is configured to receive at least a portion of a bulb;

a slot extending through the hole of the bulb holder, the first end of the cantilever, the middle portion of the cantilever, and terminating proximate to the second end of the cantilever, wherein the slot and the hole of the bulb holder form a continuous space to enable the hole to temporarily deform and permit passage of the at least the portion of the bulb, said bulb having a second diameter that is larger than the first diameter of the hole; and wherein the second end of the cantilever is resiliently capable of being pulled away from the elongated body to accommodate a positioning of a structure between the elongated body and the cantilever, and wherein the clip is made from a substantially resilient material having a memory that causes the second end of the cantilever to return toward a relaxed position when not subject to an external force, and wherein, when the structure is situated between the elongated body and the cantilever, the memory causes the second end of the cantilever to return toward the relaxed position, such that the cantilever and the elongated body exert pressure on the structure, to thereby maintain the position of the clip about the structure.

2. The clip of claim 1, wherein the slot extends substantially along the strut from the first end of the strut to the second end of the strut, wherein the strut comprises a first strut section and a second strut section separated by a portion of the slot extending along the strut.

3. The clip of claim 2, wherein the slot further extends along a portion of the elongated body from the second end of the elongated body toward the first end, forming a first body section and a second body section separated by a portion of the slot extending along the elongated body.

4. The clip of claim 3, wherein the first body section includes a first protrusion extending therefrom toward the cantilever, and wherein the second body section includes a second protrusion extending therefrom toward the cantilever.

5. The clip of claim 1, wherein the elongated body further comprises at least one protrusion extending from a surface of the elongated body toward the cantilever.

6. The clip of claim 1, wherein the cantilever comprises a lobe extending from the second end of the cantilever toward the elongated body.

7. The clip of claim 1, wherein the bulb holder has a front side and a back side, and wherein the bulb holder further comprises:

an annular outer flange on the front side of the bulb holder having an inner radius and an outer radius, wherein the hole is within the inner radius of the annular outer flange; and a socket guide ridge on the back side of the bulb holder having an inner radius and an outer radius, wherein the length of the outer radius of the socket guide ridge is less than the length of the outer radius of the annular outer flange.

8. The clip of claim 1, wherein the substantially resilient material is a synthetic resin material.

9. The clip of claim 8, wherein the synthetic resin material comprises one or more of an acrylic, a polycarbonate, a nylon, a polyethylene, and a polypropylene.

10. The clip of claim 1, wherein the clip is integrally formed as a one piece construction.

11. A clip comprising:

a gripping section that includes at least a body and a cantilever rigidly coupled to the body, wherein the cantilever includes a first end, a second end, and a middle portion disposed between the first and second ends, wherein the cantilever is resiliently capable of being pulled away from an elongated body to accommodate a positioning of a structure between the body and the cantilever, and wherein the gripping section is made from a substantially resilient material having a memory that causes the cantilever to return toward a relaxed position when not subject to a force;

a substantially circular bulb holder rigidly connected to and extending from the gripping section, wherein the bulb holder includes a hole having a first diameter and is adapted to receive at least a portion of a bulb; and a cutout extending through the hole, the first end of the cantilever, the middle portion of the cantilever, and terminating proximate to the second end of the cantilever, wherein the cutout enables the hole to expand and permit passage of the bulb having a second diameter that is larger than the first diameter.

12. The clip of claim 11, wherein the bulb holder has a front side and a rear side, wherein the clip is configured to mount a substantially ovoid bulb having a front end and a rear end opposite the front end that includes electrical contacts for powering the bulb, and wherein the hole of the bulb holder is adapted to permit passage of the substantially ovoid bulb in a first direction defined by passing the front end of the bulb through the rear side of the bulb holder and toward the front side of the bulb holder.

13. The clip of claim 12, wherein the hole of the bulb holder is further adapted to prohibit passage of the substantially ovoid bulb in a second direction defined by passing the rear end of the bulb through the front side of the bulb holder and toward a back side of the bulb holder.

14. The clip of claim 11, wherein the gripping section further includes a strut extending between and rigidly coupling the body and the cantilever.

15. The clip of claim 14, wherein the cutout extends substantially along the strut, wherein the strut comprises a first strut section and a second strut section separated by a portion of the slot extending along the strut.

16. The clip of claim 11, wherein the cutout extends substantially along the cantilever.

17. The clip of claim 11, wherein the cutout further extends along a portion of the body forming a first body section and a second body section separated by a portion of the cutout extending along the body.

18. The clip of claim 11, further comprising:

a neck situated between and rigidly connecting the cantilever and the bulb holder.

19. A clip for mounting decorative light bulbs comprising:

a first gripping section that includes a first body section and a first cantilever section, the first cantilever section having a first end, a second end, and a middle portion disposed between the first and second ends of the first cantilever section;

a second gripping section that includes a second body section and a second cantilever section, the second cantilever section having a first end, a second end, and a middle portion disposed between the first and second ends of the second cantilever section, wherein the second ends of the first and second cantilever sections are integrally affixed;

a bulb holder coupled to the first gripping section and the second gripping section, wherein the bulb holder includes a hole having a resting diameter; and a gap extending through the hole of the bulb holder, between the first ends of the first and second cantilever sections, between the middle portions of the first and second cantilever sections, and terminating proximate to the second ends of the first and second cantilever sections, wherein the clip is formed from a substantially resilient material capable of temporary deformation, wherein the first gripping section and the second gripping section are adapted to expand away from each other to, in turn, cause the hole of the bulb holder to expand, such that the bulb holder is adapted to permit passage of an object therethrough having a diameter that is larger than the resting diameter of the hole of the bulb holder.

* * * * *